US005175406A

United States Patent [19]

Roussy et al.

[11] Patent Number: 5,175,406

[45] Date of Patent: Dec. 29, 1992

[54] RESONANT HIGH-FREQUENCY OR MICRO-WAVE APPLICATOR FOR THERMAL TREATMENT OF CONTINUOUSLY MOVING FLAT MATERIAL

[75] Inventors: Georges Roussy, Laxou; Bertrand Meyer, Lyons; Jean-Francois Rochas, Caluire; Christophe Debard, Oullins, all of France

[73] Assignee: Centre Technique Industriel dit: Institut Textile de France, France

[21] Appl. No.: 781,764

[22] Filed: Oct. 23, 1991

[30] Foreign Application Priority Data

Oct. 25, 1990 [FR] France ..... 90 13629

[51] Int. Cl.[5] ..... H05B 6/40

[52] U.S. Cl. ..... 219/10.61 R; 219/10.55 A; 219/10.81

[58] Field of Search ..... 219/10.55 A, 10.55 M, 219/10.61 R, 10.81

[56] References Cited

U.S. PATENT DOCUMENTS

| | | | |
|---|---|---|---|
| 2,512,311 | 6/1950 | Davis | 219/10.81 |
| 2,783,347 | 2/1957 | Warren | 219/10.55 A |
| 2,897,328 | 7/1959 | Alf et al. | 219/10.61 R |
| 3,437,778 | 4/1969 | Seulen et al. | 219/10.61 |
| 3,532,848 | 10/1970 | Loring, Jr. et al. | 219/10.61 R |
| 4,112,285 | 9/1978 | Pan et al. | 219/10.81 |

*Primary Examiner*—Geoffrey S. Evans
*Assistant Examiner*—Tuan Vinh To
*Attorney, Agent, or Firm*—Ladas & Parry

[57] ABSTRACT

A resonant high-frequency or micro-wave applicator for the thermal treatment of a flat material is disclosed. This applicator comprises a flat capacitor between the plates of which the material moves and an inductor which is constituted by a metal band extending transversely the plate acting as hot electrode. The inner face of the plate acting as ground electrode is divided into elementary sections by an assembly of longitudinal grooves. Preferably, the same applies to the inner faces of the plate acting as hot electrode and the inductor.

9 Claims, 2 Drawing Sheets

RESONANT HIGH-FREQUENCY OR MICRO-WAVE APPLICATOR FOR THERMAL TREATMENT OF CONTINUOUSLY MOVING FLAT MATERIAL

FIELD OF THE INVENTION

The present invention relates to a resonant high-frequency or micro-wave applicator, i.e. a device capable of applying an electro-magnetic radiation in the high-frequency or micro-wave frequency range on a continuously advancing flat material, particularly a textile material, a paper or a non-woven fabric. It concerns more particularly an applicator comprising a capacitor between the plates of which the flat material moves.

BACKGROUND OF THE INVENTION

It is already known to subject an advancing flat material to the action of an electro-magnetic radiation by passing it between the plates of a capacitor, for example to dry it or heat it. However, the use of such applicators raises difficulties; in particular, it is difficult to obtain a good uniformity of the treatment in the transverse direction of the material; furthermore, regulation of the treatment is very delicate, especially when the characteristics of the material vary as a function of the temperature of the material.

An applicator of this type is supplied by a generator of which the operational parameters are imposed by the manufacturer. To obtain sufficient conditions of stability, it is always necessary to dispose between the generator supplying the electro-magnetic energy and the applicator, an additional electro-magnetic circuit, commonly called matching box. Such matching boxes are most often constituted by inductors and capacitors and do not comprise resistive elements which are capable of dissipating heat and consequently reduce the total energetic yield of the installation.

However, Applicants have noted that, despite the presence of a matching box intended to regulate matching of the impedances of the generator and of the applicator, a phenomenon of thermal racing might be produced. This phenomenon is produced in particular when the dielectric constant of the material to be treated presents a considerable variation as a function of the temperature, even when the intensity of the electric field applied to said material is constant.

It has already been sought to avoid this phenomenon of thermal racing by measuring the temperature of the product and reducing the electric field applied. However, this solution is difficult to implement due to the inertia of the servo-mechanisms which are necessary.

Applicants' purpose is to propose an applicator which overcomes all the drawbacks observed, in that it makes it possible to obtain uniformity of the treatment in the transverse direction of the material and in that it is self-regulating, i.e. it corrects by itself the conditions of its functioning due to the variations of the characteristics of the material to be treated.

U.S. Pat. No. 3,532,848 already proposes a resonant high-frequency or micro-wave applicator for the treatment of a flat material whose functioning is independent of its width. This applicator comprises, in known manner, a flat capacitor between the plates of which the material to be treated moves. It comprises, as characteristic, on one side of the material, two successive plates connected together by a plurality of inductors or by a single inductor, continuous over the whole of their width.

The inductor constitutes with the capacitance of the flat capacitor an oscillating circuit whose functioning is independent of the width of the applicator. In fact, it is known that the value of the air inductor or self-inductance of a coil with contiguous turns is given by the formula:

$$L = \mu_0 \frac{\pi R^2}{l}$$

in which R is the radius of the winding, l the length of the coil and $\mu_o$ the permeability of the vacuum. It is also known that the capacitance of a flat capacitor of which the plates are rectangular is given by the formula:

$$C = \epsilon_0 \frac{l \cdot d}{e}$$

in which $\epsilon_o$ is the permettivity of the vacuum, l and d respectively the width and length of a plate and e the distance between the two plates.

In the present case, the inductor and the capacitance are connected in distributed manner over the whole length l of the inductor, depending on the width of the same dimension l of the capacitor.

The square of the resonance frequency of the oscillating circuit is equal to the reciprocal of the product LC.

$$\omega^2 = \frac{l}{LC}$$

By calculation, it is deduced that:

$$\omega^2 = \frac{l}{\mu_0 \cdot \epsilon_0 \pi} \quad \frac{e}{d \cdot R^2}$$

It is therefore ascertained that the resonance frequency of the applicator is, in this type of applicator, independent of the width l of the plates.

However, an applicator as described in U.S. Pat. No. 3,532,848 is not self-regulating.

An applicator has now been found, and this is what forms the subject matter of the present invention, which makes it possible to obtain uniformity of the treatment in the transverse direction of the material and which is self-regulating.

SUMMARY OF THE INVENTION

It is question of an applicator which comprises in known manner a flat capacitor between the plates of which said material moves and an inductor constituting with the capacitance of the capacitor an oscillating circuit. In accordance with the characteristic of the invention, the inductor is constituted by a metal band extending transversely over its whole width the plate of the capacitor acting as hot electrode; moreover, the inner face of the plate of the capacitor acting as ground electrode is divided into elementary sections by an assembly of longitudinal grooves, in the direction of displacement of the material.

Taking into account this structural particularity, it may be considered that the longitudinal grooves define elementary sections which are elementary applicators of small dimensions, having the same resonance frequency and not having interactions therebetween. This structure makes it possible to obtain the desired self-regulation.

In fact, when the characteristics of the material passing between the plates of the capacitor fluctuate, there follow variations in the value of the capacitance of the capacitor and consequently of the resonance frequency of the oscillating circuit. Correlatively, the electrical voltage applied to the terminals of the capacitor will vary and compensate the fluctuations in question, as will be explained in the following description.

The elementary sections preferably have a width which is 5 cm maximum. It is advantageously of the order of or less than a centimetre.

The inner faces of the plate of the capacitor acting as hot electrode and of the inductor are preferably divided into elementary sections by an assembly of longitudinal grooves disposed opposite the grooves made in the plate of the capacitor acting as ground electrode. Such grooving of the other elements makes it possible to reinforce the independence of the elementary applicators.

The inductor is preferably constituted by a metal band in the form of an arc of circle, extending transversely the plate of the capacitor acting as hot electrode.

The metal band curved in an arc of circle may be assimilated to a contiguous-turn coil.

According to the preferred embodiment of the invention, the applicator comprises two flat capacitors, of which the plates acting as hot electrodes are in the same plane and connected by the ends of the arcuate metal band, constituting the inductor.

If the inductor is constituted by an arcuate metal band, the resonance frequency of the applicator may be adjusted thanks to means for deforming the metal band, making it possible to vary the inner section of the inductor. For example, it is question of a metal plate which is in contact with the outer face of the metal band and which is equipped with a system of slide, adapted to exert a stress on the band such that the arc of circle is deformed uniformly over the whole length of the inductor.

The resonance frequency of the applicator may also be adjusted thanks to means for adjusting the distance between the plates of the capacitor.

Another means for adjusting the electro-magnetic field on the material may consist in bars mounted transversely on those faces of the plates of the capacitor facing the material; such bars are adapted to vary the intensity of the electro-magnetic field and to concentrate it on the product to be treated. They are particularly useful when the material to be treated is of small thickness.

According to the invention and in order not to create transverse interactions, the transverse bars are themselves divided into elementary sections by longitudinal grooves, disposed opposite the grooves made in the plate of the capacitor acting as ground electrode. The elementary sections may be separated from one another by blades of an insulating material.

Supply of the applicator is preferably ensured by a generator connected thanks to a flange coaxial, on the one hand, to a first metal band of progressive section extending the plate of the capacitor acting as ground electrode and, on the other hand, to a second metal band of progressive section whose end forming coupling band is placed parallel and opposite another coupling band extending in superelevation the plate of the capacitor acting as hot electrode, the two coupling bands acting as coupling capacitance.

This particular arrangement makes it possible to obtain a distributed coupling of considerable homogeneity in the transverse direction.

In the preferred embodiment, the applicator comprises two capacitors whose plates acting as hot electrodes are connected by an inductor; it is possible to place in series a plurality of applicators of this type, and also to increase the number of inductors succeeding capacitances in the direction cf advance of the material. The advantage of this solution is that the time of treatment is increased and the total energy available is distributed in the direction of advance if one is limited by the maximum voltage applied.

BRIEF DESCRIPTION OF THE DRAWINGS

The invention will be more readily understood on reading the following description of the preferred embodiment of a resonant applicator with two capacitances connected by an inductor distributed over the same length in the transverse direction, with reference to the accompanying drawings, in which.

DETAILED DESCRIPTION OF THE DRAWINGS

Figure 1:
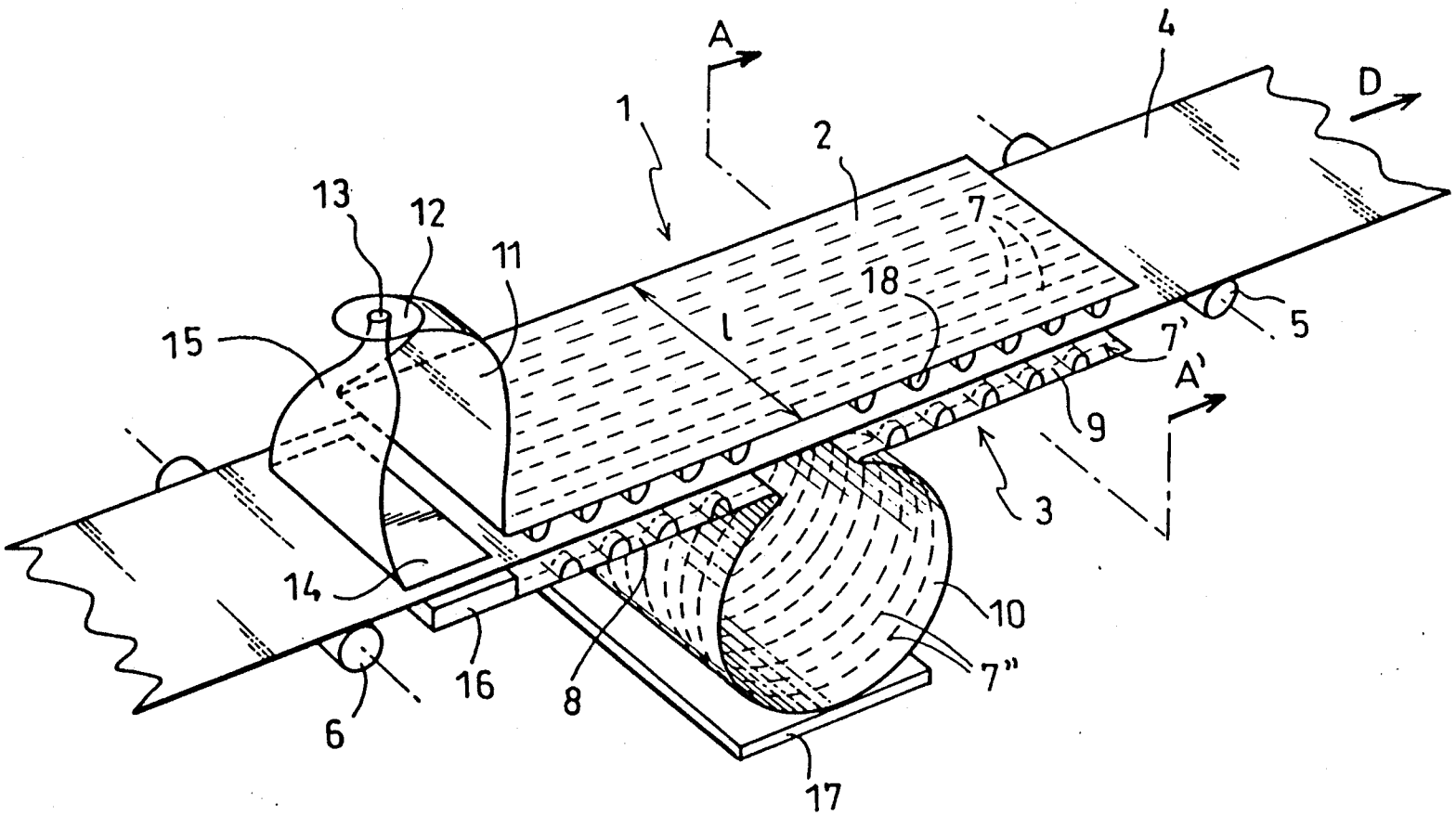
FIG. 1 is a schematic view in perspective of the applicator according to the invention traversed by a flat material.

Referring now to the drawings, the resonant high-frequency or micro-wave applicator 1 is constituted by an upper plate 2 and a lower plate 3 parallel to and opposite each other, between which a flat material 4 moves. This material is for example a woven fabric, a knitted fabric, a non-woven fabric, paper, a plastic film, . . .

At the entrance and exit of the applicator, the material 4 is supported by two rollers 5, 6 respectively, positioned so that the material is flat between these two rollers 5, 6 and without contact with the two plates 2, 3 and parallel thereto.

The upper plate 2 is a rectangular metal plate whose width 1, i.e. the dimension measured in the transverse direction of displacement of the material in the direction of arrow D, is at least equal to and preferably greater than the width of the material 4.

The inner face of the upper plate 2, facing the flat material 4, presents longitudinal grooves, illustrated in FIG. 1 by broken lines 7.

These grooves 7 are such that they define the elementary sections 19 of small dimensions, of the order of one centimetre in width, independent of one another. The distance between two sections 19, corresponding to the width of a groove 7, is small, of the order of one to some millimetres. It will be understood that maintaining of the different elementary sections 19 in position may be ensured by an assembly with the aid of an insulating material.

The lower plate 3 of the same overall dimensions as the upper plate 2, is composed of two rectangular portions 8, 9 connected together by a metal band 10 curved in an arc of circle towards the outside of plate 3.

The inner face of the two portions 8, 9 of the lower plate 3 presents longitudinal grooves, illustrated in FIG. 1 by broken lines 7', and disposed opposite the grooves 7 made in the upper plate 2. The grooves 7' define elementary sections 20.

Transverse bars 18 are fixed, by screwing, on the inner faces, facing the flat material 4, of the upper plate 2 and of the lower portions 8, 9, either opposite, or in quincunx, as shown in FIG. 1.

The transverse bars 18 are also grooved, in the same manner as plates 2, 3, so as to define elementary sections 22 which are separated from one another by blades 23 of an insulating material.

The front transverse edge of the upper plate 2 is extended by a first metal band 11 whose width decreases progressively to a dimension allowing connection to a flange 12 connected to a high-frequency or micro-wave generator (not shown). It is the ground of the coaxial flange 12 which is connected to the first metal band 11.

The central electrode 13 of the coaxial flange 12 is in contact with an upper coupling band 14 via a second metal band 15. The upper coupling band 14 is a rectangular metal plate placed in front of the upper plate 2, of short length and of width equivalent to that, 1, of the upper plate 2. It is flush with the flat material 4, parallel thereto. The second metal band 15 connects the central electrode 13 to the upper coupling band 14. Its width decreases progressively from the upper coupling band 14 which it extends up to the central electrode 13.

The front lower portion 8 is extended by a lower coupling band 16 which is a metal plate in superelevation with respect to the inner face of said portion 8. This lower coupling band 16 faces the upper coupling band 14, being separated therefrom by a sufficient distance to allow passage of the flat material 4.

In this way, the two lower portions 8, 9 are the hot electrodes of two capacitors, of which the ground electrodes are constituted by the upper plate 2; the arcuate metal band 10 constitutes the inductor of the oscillator circuit.

The inner face of the arcuate metal band 10 presents longitudinal grooves 7'', disposed opposite the grooves 7 made in the upper plate 2.

Supply of the hot electrodes with energy is effected thanks to the coupling between the upper coupling band 14 supplied by the generator and the lower coupling band 16, the two upper and lower bands 14, 16 forming a coupling capacitance.

Applicator 1 presents two systems for adjusting the resonance frequency. The first is a system for deforming the arcuate metal band 10 forming the inductor; it comprises a metal plate 17 abutting on an outer generatrix of the arc of circle, and sliding means, for example sets of threaded rods and nuts enabling said plate 17 to be displaced vertically by a determined, adjustable height. Such a displacement correlatively brings about a deformation of the arc of circle and consequently a variation in the section of the inductor. It will be understood that this variation of the surface of said section of the inductor causes the resonance frequency to vary.

The second system for adjusting the resonance frequency of the applicator is a system for adjusting the distance of the upper plate 2 with respect to the two fixed lower portions 8, 9. It is question for example of a set of jacks fixed on a frame and whose rods are fast with the upper plate 2, having several possible positions of adjustment.

On either side of the applicator 1, facing the open ends of the arcuate band 10, are placed two vertical metal plates (not shown in FIG. 1 for reasons of clarity); these plates have such dimensions that they project largely from the inductor; they are connected to the upper plate 2. The role of these plates is to stop the magnetic field created by the inductor.

Figure 2:
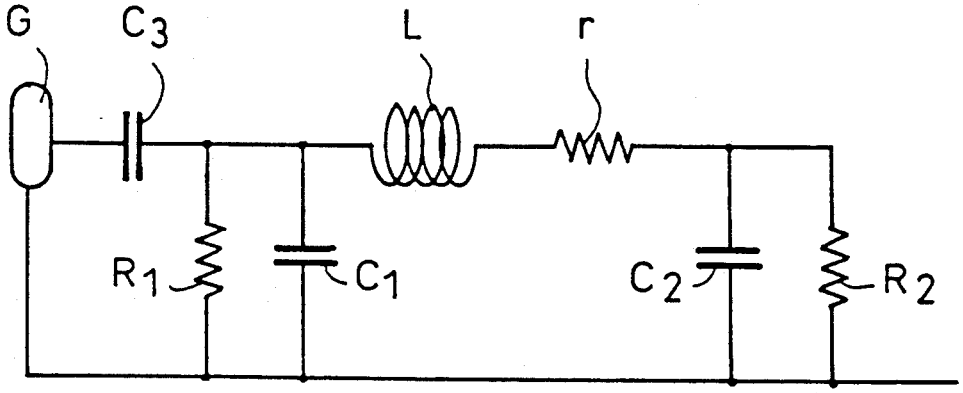
FIG. 2 is the corresponding electrical diagram.
Figure 3:
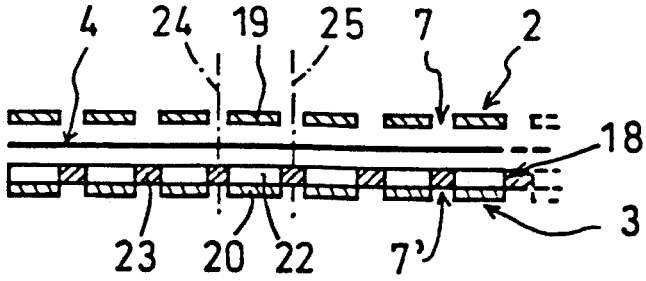
FIG. 3 is a schematic view in section of the applicator along plane AA' of FIG. 1.

Functioning of the applicator is explained by the equivalent electrical diagram shown in FIG. 2, in which is found the applicator proper, constituted by the inductor L corresponding to the arcuate metal band 10, and two capacitances $C_1$ and $C_2$, corresponding to the two portions 8, 9 and to the upper plate 2, connected between the ends of the inductor and the ground.

The applicator is connected to generator G by the coupling capacitance $C_3$ corresponding to the two upper and lower coupling bands 14, 16. Resistors $R_1$ and $R_2$ represent the transformation of the material during the treatment, for example the heating of the material corresponds to the power dissipated in each of the resistors $R_1$ and $R_2$. The power dissipated in resistor r, in series with inductor L, represents the power dissipated in the applicator and the losses thereof.

It is easy for the man skilled in the art to determine the value of each of the equivalent elements of the circuit, from the measurements made with an impedance meter and a network analyzer.

For example, in order to determine the value of the coupling capacitance $C_3$, it suffices to measure the impedance at the input of the applicator when the first capacitance is short-circuited by a metal plate which connects the two electrodes of the capacitor.

For example, to determine the value of the capacitances $C_1$ and $C_2$, it suffices to short-circuit the inductor by connecting the two sections 8, 9 of the lower plate 3.

For example, to determine the value of the inductor L, it is obtained by measuring the resonance frequency. For example, to determine the value of the resistance of the inductor, it is obtained by determining the value of the overvoltage factor of the oscillating circuit in the absence of flat material 4.

It is necessary to make such measurements in the event of modifications of the adjustment of the applicator: distance between the plates, number of transverse bars, deformation of the inductor.

From the values thus measured, and from the equivalent electrical diagram, it is possible, simply by applying Ohm's law, to calculate the mean electrical voltage which appears between the electrodes of the capacitors when the generator is connected, the latter delivering a known electrical voltage. Moreover, the equivalent diagram makes it possible to effect the power balance and thus to calculate the power transferred to the product, the power consumed in the applicator and the total reflected power by the applicator.

For correct functioning of the applicator, it is necessary to know how the flat material 4 to be treated behaves during treatment, and in particular how its dielectric constant will evolve as a function of the temperature. In fact, the adjustment of the resonance frequency will be determined taking this information into account so as to obtain the desired self-regulating effect. The resonance frequency will be chosen either slightly greater than or less than the frequency of the generator.

The assembly of the elementary sections 19, 20, 21 defined by the vertical planes 24, 25 passing through two successive grooves, respectively in the upper plate 2, in the lower plate 3, in the transverse bars 18 and in the arcuate metal band 10, forms an independent elementary applicator.

Let it be assumed that a variation in the characteristics of the material occurs locally in an elementary applicator. If the resonance frequency has been chosen to be slightly higher than the frequency of the generator and if this variation tends to reduce the value of the capacitance of the oscillating circuit, this will bring about for this elementary applicator an increase in the resonance frequency of the oscillating circuit and a reduction in the voltage applied to the terminals of the capacitor. The power supplied to the material, in this elementary applicator, will decrease.

On the contrary, if the resonance frequency of the oscillating circuit has been chosen to be less than the frequency of the generator, the same fluctuation tends to reduce the distance between the two frequencies and leads to supplying the capacitor by a greater electrical voltage, i.e. to increase the power supplied to the material in this elementary applicator.

Each elementary applicator functioning independently, the effect of regulation is local and does not modify the treatment of the material located in the adjacent elementary applicators.

The man skilled in the art will, as a function of the physical and dielectric characteristics of the flat material to be treated, determine the operational conditions of the applicator 1 according to the invention: choice of the resonance frequency with respect to the frequency of the generator, adjustment of the section of the inductor and/or of the distance between the upper plate 2 and the lower sections 8, 9 to obtain the adequate resonance frequency, presence or not of the transverse bars 18 making it possible to concentrate the electric field on the flat material 4, particularly when it is not thick.

It will be understood that, due to the effect of self-adjustment of the applicator according to the invention, it is always possible subsequently to adjust the value of the capacitance $C_3$ in order to adjust the overall impedance of the applicator and render it equal to that of generator G. This renders unnecessary the use of a matching box, as is generally provided between the generator and the conventional applicators.

The invention is not limited to the preferred embodiment which has been described by way of nonlimiting example, but covers all the variants thereof. In particular, the applicator may comprise a plurality of inductors, for example the lower plate will then be composed of three lower portions as described hereinabove, separate and connected together by two arcuate metal bands acting as inductors. This version makes it possible to increase the treatment time and to distribute in the direction of advance of the flat material the total energy available; it is interesting when one is limited by the maximum voltage applied.

Furthermore, the arcuate shape of the inductor is not limiting; it may for example present a substantially square shape. In that case, the variation of the inner section of the inductor will be obtained by displacement of its base, mobile, along its fixed lateral sides.

Finally, the applicator according to the invention will preferably be installed inside a box electrically connected to the ground of the generator and acting as electro-magnetic screen.

It should be noted that, thanks to the progressive section of the metal bars 11, 15, all the elementary applicators are supplied with current under the same conditions. Such homogeneous distribution of the current in the transverse direction, which further increases the performances of self-regulation, might possibly be obtained by other means, within the scope of the man skilled in the art.

What is claimed is:

1. A resonant high-frequency of micro-wave applicator for the treatment of a flat material, comprising a flat capacitor including at least two plates between which said material moves and an inductor, constituting with the capacitor an oscillating circuit, the inductor being constituted by a metal band transversely extending the plate of the capacitor acting as hot electrode, and the plate of the capacitor acting as ground electrode having its inner face divided into elementary sections by an assembly of longitudinal grooves in a direction of displacement of the material.

2. The applicator of claim 1, wherein the elementary sections have a width equal to or less than a centemetre.

3. The applicator of claim 1 or 2, wherein, the inner faces of the plate of the capacitor acting as hot electrode and of the metal band acting as inductor are divided into elementary sections by an assembly of grooves disposed opposite the grooves in the plate of the capacitor acting as ground electrode.

4. The applicator of claim 1, wherein it comprises two flat capacitors, of which two plates acting as hot electrodes are in the same plate towards the plate of ground electrode, and connected by the ends of an arcuate metal band constituting the inductor.

5. The applicator of claim 4, wherein it comprises means for deforming the metal band, adapted to vary the inner section of the inductor.

6. The applicator of claim 5, wherein the deformation means consists in a metal plate which is in contact with an outer face of the metal band and which is equipped with a system of slide, adapted to exert a stress on the metal, band such that the arcuate metal band is deformed uniformly over the whole length of the inductor.

7. The applicator of claim 1, wherein it comprises bars mounted transversely on the inner faces of the plates of the capacitor, adapted to vary the intensity of the electro-magnetic field and to concentrate it on the flat material, and divided into elementary sections by an assembly of longitudinal grooves disposed opposite the grooves in the plate of the capacitor acting as ground electrode.

8. The applicator of claim 1, wherein it comprises, for supplying the applicator, a generator connected through a flange coaxial, on the one hand, to a first metal band of progressive section extending the plate of the capacitor acting as ground electrode and, on the other hand, to a second metal band of progressive section having a flat end forming a coupling band placed parallel to and opposite another coupling band extending in superelevation the plate of the capacitor acting as hot electrode, the two coupling bands acting as coupling capacitance.

9. The applicator of claim 1, wherein it comprises a plurality of grooved inductors alternating with capacitor plates in the direction of displacement of the material.

* * * * *